US012791040B2

(12) United States Patent
Bamberger et al.

(10) Patent No.: US 12,791,040 B2
(45) Date of Patent: Nov. 10, 2026

(54) AXIAL FAN

(71) Applicant: Viessmann Holding International GmbH, Allendorf (DE)

(72) Inventors: Konrad Bamberger, Dautphetal (DE); Andreas Schubert, Battenberg (DE)

(73) Assignee: Viessmann Holding International GmbH, Allendorf (DE)

( * ) Notice: Subject to any disclaimer, the term of this patent is extended or adjusted under 35 U.S.C. 154(b) by 0 days.

(21) Appl. No.: 19/283,753

(22) Filed: Jul. 29, 2025

(65) Prior Publication Data

US 2026/0036142 A1 Feb. 5, 2026

(30) Foreign Application Priority Data

Jul. 31, 2024 (EP) ..... 24192121

(51) Int. Cl.

| | |
|---|---|
| ***F04D 29/54*** | (2006.01) |
| ***F04D 19/00*** | (2006.01) |
| ***F04D 29/16*** | (2006.01) |
| ***F25D 17/06*** | (2006.01) |

(52) U.S. Cl.

CPC ..... *F04D 29/541* (2013.01); *F04D 19/002* (2013.01); *F04D 29/164* (2013.01); *F25D 17/067* (2013.01)

(58) Field of Classification Search

CPC .... F04D 29/541; F04D 19/002; F04D 29/164; F04D 29/545; F04D 29/4226; F04D 29/441; F25D 17/067

See application file for complete search history.

(56) References Cited

U.S. PATENT DOCUMENTS

| | | | | |
|---|---|---|---|---|
| 3,937,192 | A * | 2/1976 | Longhouse | F01P 5/06 123/41.58 |
| 4,566,852 | A * | 1/1986 | Hauser | B01D 53/005 416/189 |
| 5,701,854 | A * | 12/1997 | Hauser | F04D 29/164 416/189 |
| 7,189,053 | B2 * | 3/2007 | Winkler | B29C 45/1676 415/213.1 |
| 7,789,622 | B2 * | 9/2010 | Acre | F04D 29/526 416/189 |

(Continued)

FOREIGN PATENT DOCUMENTS

| | | |
|---|---|---|
| DE | 44 38 184 C1 | 4/1996 |
| DE | 10 2004 033 215 A1 | 2/2005 |
| WO | 2020/099027 A1 | 5/2020 |

OTHER PUBLICATIONS

European Search Report for EP 24 19 2121 dated Jan. 8, 2025.

*Primary Examiner* — Eldon T Brockman
(74) *Attorney, Agent, or Firm* — Sughrue Mion, PLLC

(57) ABSTRACT

An axial fan has a nozzle and a rotatable impeller which has freely ending blades. The nozzle forms a main flow duct which connects an inflow side of the fan to an outflow side of the fan and defines a main flow direction as a result. The nozzle surrounds the impeller, wherein it does not corotate with the impeller. A bypass duct forms a flow connection from an outflow-side surrounding area of the nozzle into an inflow-side region of the main flow duct for the purpose of returning outflow-side air into the main flow duct of the nozzle. The axial fan reduces the noise emission and makes an extension of the breakaway-free operating range possible.

18 Claims, 4 Drawing Sheets

(56) References Cited

U.S. PATENT DOCUMENTS

| | | | | |
|---|---|---|---|---|
| 9,334,877 | B2 * | 5/2016 | Nicholls | F04D 29/58 |
| 11,598,539 | B2 * | 3/2023 | Avedon | F04D 19/002 |
| 11,692,553 | B2 * | 7/2023 | Haaf | F04D 17/06 417/423.1 |
| 12,031,544 | B2 * | 7/2024 | Fukui | F04D 29/164 |
| 2005/0069407 | A1 * | 3/2005 | Winkler | F04D 29/646 415/58.5 |
| 2008/0075585 | A1 * | 3/2008 | Acre | F04D 29/164 415/177 |
| 2020/0333027 | A1 * | 10/2020 | Avedon | F04D 29/544 |
| 2023/0407876 | A1 * | 12/2023 | Fukui | F04D 29/547 |

* cited by examiner

AXIAL FAN

TECHNICAL FIELD

The present invention relates to an axial fan, in particular a fan of a heat pump, for example of an air-to-water heat pump.

PRIOR ART

Axial fans (also called axial ventilators) are frequently used continuous-flow machines for conveying a gaseous medium, in particular air. They have a rotating impeller with blades. The main flow direction of the conveyed air runs parallel to the rotational axis of an impeller of the axial fan. Fans are intended to convey air in as energy-efficient a manner as possible.

DE 44 38 184 C1 describes a radiator of an internal combustion engine with a radiator shroud and a downstream axial fan. A bypass duct between the radiator shroud and the axial fan is intended to prevent a backflow vortex, wherein the inner wall of the radiator shroud is shaped in such a way that a recirculated bypass flow is deflected in the direction of the main flow.

WO 2020/099027 A1 discloses a diagonal fan with a rotor which has rotor blades and a sling ring which closes the ends of the rotor blades. The motor of the fan is connected downstream of the rotor in the main flow direction. An inlet nozzle is arranged upstream of the rotor in the flow direction. An annular bypass duct which guides a swirl-free auxiliary flow to the inflow side of the nozzle gap is provided between the inlet nozzle and the sling ring. This is intended to increase the efficiency.

Fans are also intended to operate as quietly as possible. Axial fans with blade tips, that is to say with freely ending blades, generate blade tip vortices, however, which lower the energy efficiency and are largely responsible for the noise emission.

SUMMARY OF THE INVENTION

It is therefore an object of the invention to develop an axial fan with freely ending blades which is improved with regard to its noise emission.

The axial fan according to the invention has a rotatable impeller which has freely ending blades, and a nozzle. The nozzle forms a main flow duct which connects an inflow side of the fan to an outflow side of the fan and defines a main flow direction as a result. The nozzle surrounds the impeller, wherein the nozzle does not corotate with the impeller. A bypass duct forms a flow connection from an outflow-side surrounding area of the nozzle into an inflow-side region of the main flow duct for the purpose of returning outflow-side air into the main flow duct of the nozzle.

The "blade" is also called a "vane". "Freely ending blades" are usually called "blade tips", regardless of the shape of the ends.

The bypass makes it possible for a part of the air to be returned from the outlet-side pressure side (positive pressure region) of the fan to the inlet-side suction side (negative pressure region) of the fan. Thanks to the pressure differences, this bypass flow is sucked in the direction of the inflow side.

Thanks to this bypass flow, the bypass duct reduces the blade tip vortices at the blade tips of the blades and/or deflects them in the axial direction. Thanks to the deflection and/or decrease, the blade tip vortices can interact with the neighbouring blades to a lesser extent. The noise emission is minimized as a result. This improves the aero-acoustic properties.

Despite a part of the air being returned, the energy efficiency of the fan is scarcely reduced or is even improved. One reason for this is that the reduction and deflection of the blade tip vortices delay the stall. The breakaway point is shifted towards higher back pressures. The breakaway-free operating range is extended.

Premature stalls not only reduce the energy efficiency, but rather also lead to instabilities which can set the blades vibrating and can lead to fatigue fractures. The operating range is therefore improved and the stable operating range is extended as a result.

In preferred embodiments, the bypass duct has the same inflow direction as the main flow duct when opening into the main flow duct. When opening into the main flow duct, the bypass duct preferably forms a step-free extension of an inner wall, following in the main and bypass flow direction, of the nozzle. The fan is preferably shaped in such a way that the bypass flow is ejected parallel to the inner side of the nozzle. The bypass flow is therefore preferably introduced parallel to the main flow.

The axial fan preferably has a carrier part, on which the impeller is arranged rotatably and on which the nozzle is arranged in a fixed or stationary manner. The bypass duct is formed between a wall of the carrier part and a wall of the nozzle.

The wall of the carrier part and the wall of the nozzle when opening into the bypass duct preferably have the same orientation and inclination. They form the walls of the bypass duct and make an embodiment possible which enables merging of the main flow and the bypass flow with as little turbulence as possible.

A motor which drives the impeller is preferably arranged upstream of the nozzle in the main flow direction.

In preferred embodiments, the carrier part is a motor carrier for a motor for driving the impeller. The carrier part preferably has an outer carrier part and an inner carrier part, wherein the nozzle is fastened to the outer carrier part and the motor is fastened to the inner carrier part. There are preferably struts present which fasten the inner carrier part to the outer carrier part and give the motor carrier the required stability.

The bypass duct preferably is of all-round formation. It is preferably ring-shaped. It preferably has scarcely any or no interruptions.

The orifice region of the bypass duct is preferably formed as a slot. It is preferably formed to be multiple times smaller in terms of its flow length and its cross section than the main flow duct. It is preferably situated merely in the inflow-side region of the fan.

In some embodiments, the bypass duct has an inlet opening which has a greater cross section than its outlet opening, that is to say its orifice opening. In other embodiments, the size of its cross section is approximately constant over its length, or it increases towards its orifice.

In some embodiments, the bypass duct forms an arc, preferably with an angle of more than 90°, before it opens into the main flow duct.

In preferred embodiments, the nozzle tapers at least in its inlet-side region towards the outflow side. In some embodiments, it tapers over its entire length.

Depending on the embodiment, the nozzle has a length which is greater than, approximately the same as, or smaller than the length of the impeller.

In preferred embodiments, the bypass duct opens in the main flow direction in the region of the free ends of the blades of the impeller into the main flow duct. As viewed in the axial direction, that is to say in the direction of the main flow, the bypass duct preferably opens in the region of the blade tips or adjacently downstream with respect thereto into the main flow duct, but preferably in the region of the blades as viewed in the axial direction.

Further embodiments are specified in the dependent claims.

BRIEF DESCRIPTION OF THE DRAWINGS

One preferred embodiment of the invention is described in the following with reference to the drawings, which serve merely for explanatory purposes and are not to be interpreted as restrictive. In the drawings.

DESCRIPTION OF PREFERRED EMBODIMENTS

Figure 1:
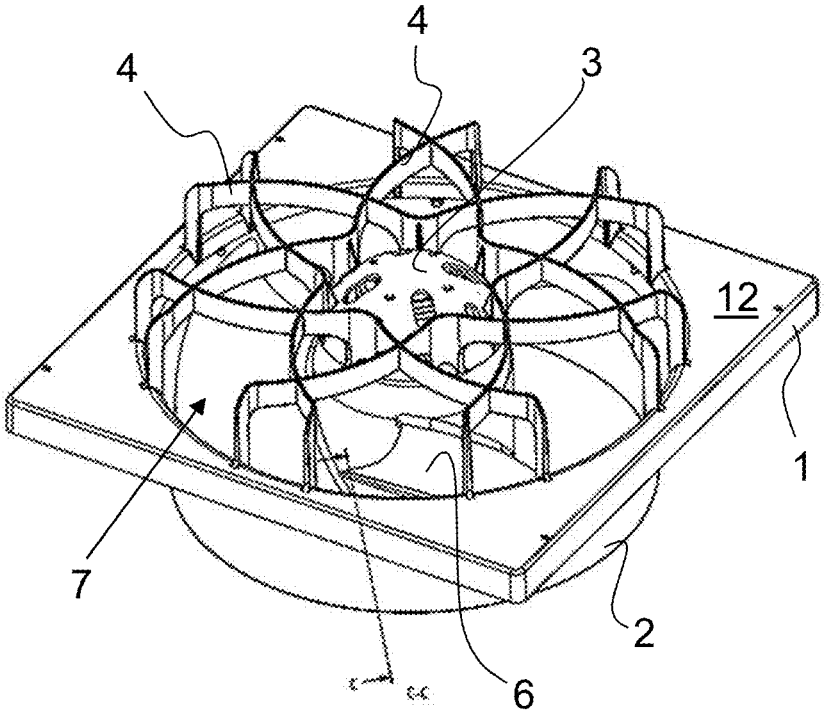
FIG. 1 shows a perspective illustration of an axial fan according to the invention from above.
Figure 2:
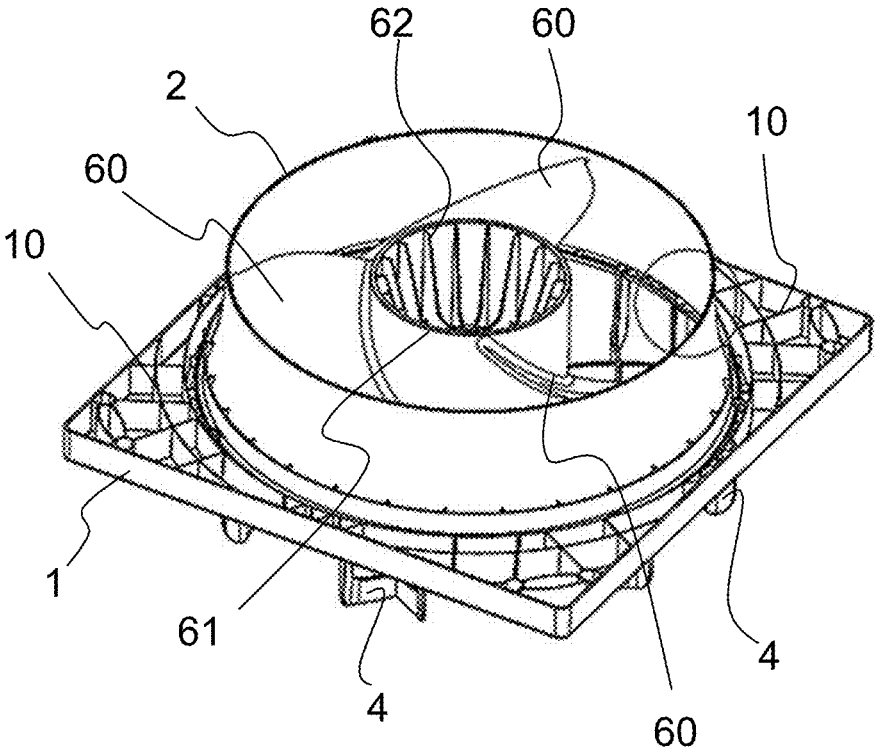
FIG. 2 shows a perspective illustration of the axial fan according to FIG. 1 from below.
Figure 3:
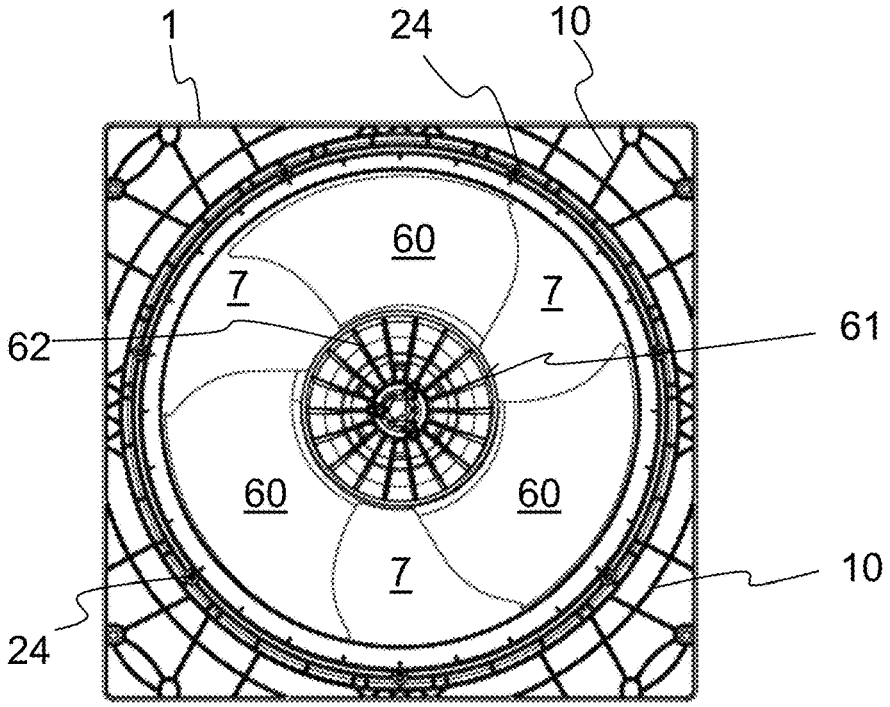
FIG. 3 shows a view of the axial fan according to FIG. 1 from below.
Figure 4:
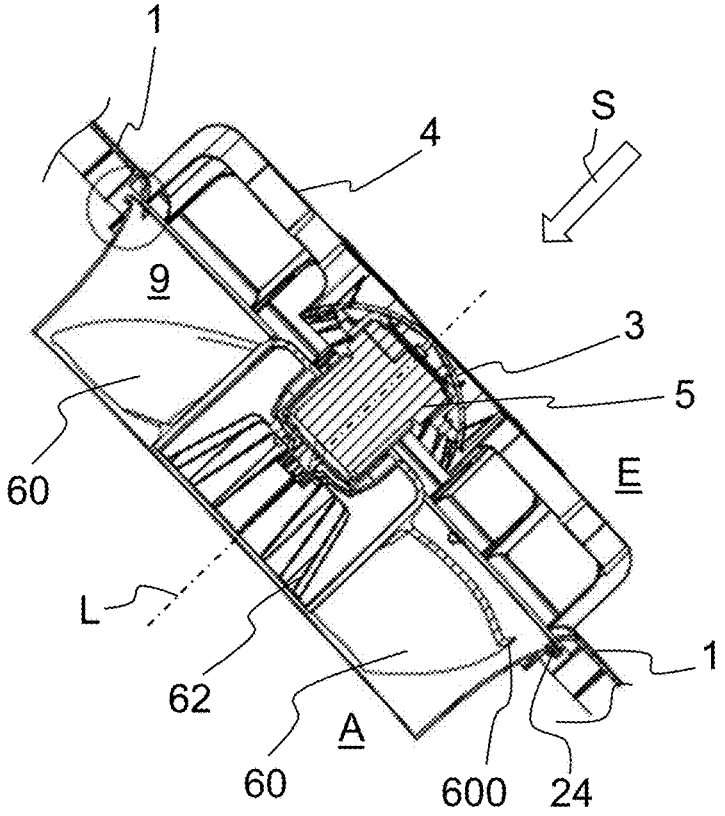
FIG. 4 shows a cross section through the axial fan according to FIG. 1.

FIGS. 1 to 4 show one preferred embodiment of an axial fan according to the invention. It has a motor carrier 1, 3, 4, a nozzle 2, a motor 5 and an impeller 6.

The motor carrier has an outer first carrier part 1, an inner second carrier part 3 and struts 4, and forms an air throughflow opening 7.

The outer first carrier part 1 usually serves as a wall ring for mounting the fan in or on a housing or in or on a building wall. The outer first carrier part 1 has a cutout which defines an air throughflow opening 7. The cutout is preferably arranged centrally.

The air throughflow opening 7 preferably has a circular shape. In this example, the outer carrier part 1 has a square basic shape. Other basic shapes are possible, for example round, oval or rectangular.

The nozzle 2 of the fan is fastened to the outer carrier part 1 of the motor carrier, preferably on its periphery. They are preferably screwed to one another. Corresponding screws are provided with the reference sign 24 in FIGS. 3, 4 and 6. This can be seen in FIG. 3. The nozzle 2 is stationary and, like the motor carrier, does not corotate with the impeller 6.

It preferably tapers in the main flow direction, that is to say away from the motor carrier and therefore away from the first carrier part 1. It tapers at least in the inflow region. It preferably tapers over the entire length of the nozzle 2.

The inner carrier part 3 and the air throughflow opening 7 are preferably arranged coaxially with respect to one another. The inner carrier part 3 and the outer carrier part 1 are preferably also arranged coaxially with respect to one another.

The inner carrier part 3 is configured to receive, preferably to mount the motor 4, preferably an electric motor. In this example, the inner carrier part 3 has a motor housing in the form of a dome with a curved surface which faces the air flow. This can be seen clearly in FIGS. 1 and 4. The main flow direction S is shown using an arrow in FIG. 3. The inner carrier part 3 has through openings for fastening the motor 5 by means of screws in the motor housing and/or for leading through power and/or sensor cables.

The motor carrier comprises the struts 4. They serve to connect the inner carrier part 3 to the outer carrier part 1, wherein they ensure sufficient stability for the motor carrier and therefore for the entire fan.

The embodiment of the motor carrier which is shown here is merely by way of example. It can also be of different configuration. In particular, differently shaped struts can be used or, instead of struts, a grill can also be used or different connecting and stabilizing elements can be used.

The motor carrier 1, 3, 4 and/or the nozzle 2 are/is preferably configured in one part. They are preferably manufactured from plastic.

The impeller 6 (also called an impeller wheel or propeller) is preferably fastened to the motor 5. It can be rotated by means of the motor 5 about the axis L of the fan and therefore of the motor carrier.

In this example, the impeller 6 has three blades 60. The blades 60 are also called vanes or wings. The blades 60 are arranged on an inner ring 61. Ribs 62 reinforce the inner ring 61 and therefore the impeller 6. This can be seen clearly in FIGS. 2 to 4.

The blades 60 end in free blade tips 600. In this embodiment, the blade tips 600 (also called vane tips) are bent upwards counter to the main flow direction S, and they are of acutely tapering configuration. The tips which project counter to the main flow direction S and therefore face the negative pressure region preferably run in the axial direction. They are preferably also of curved configuration in the peripheral direction, that is to say along the circular periphery defined by the impeller, counter to the rotational direction of the impeller. This can be seen clearly in FIGS. 4 and 7. They can also have other shapes, however.

The number and shape of the blades 60 and the remaining components of the impeller 6 are merely exemplary here. The impeller 6 can also be of different configuration.

The fan has an inflow side E and an outflow side A. As a result of the rotation of the impeller 6, a low pressure region or a suction side arises on the inflow side E, and a positive pressure region or a pressure side arises on the outflow side A. These two sides are labelled by the reference signs E and A in FIG. 4.

In order to reduce and/or deflect blade tip vortices at the ends or tips 600 of the blades 60, there is a bypass duct 8 present. It can be seen in FIGS. 5 to 7.

The bypass duct 8 is ring-shaped, wherein it is preferably of all-round configuration with only absolutely necessary interruptions or without interruptions. It is configured to be multiple times smaller than the main flow duct which also comprises the air throughflow opening 7.

Walls of the outer carrier part 1 and of the nozzle 2 form the walls of the bypass channel 8. The outer carrier part 1 has a cover surface 12 on the inflow side and reinforcing ribs 11 on the outflow side. This can be seen in FIGS. 1 and 2.

The cover surface 12 is of closed configuration with the exception of the air throughflow opening 7. An outer shell 11 that extends all round protrudes from this surface in the direction of the outflow side A. An inner shell 14 that extends all round is situated at a spacing from the outer shell 11. The cover surface 12 protrudes radially inwards and beyond the inner shell 14 and forms an inner apron 13. The apron 13 is of curved configuration and protrudes with its free end in the direction of the outflow side A. This can be seen in FIG. 6.

The nozzle 2 has at least one apron which protrudes to the outside and in the direction of the outflow side and forms the bypass duct 8 together with the inner shell 14 and the inner apron 13 of the first carrier part 1.

In this example, the nozzle 2 (see FIG. 6) has a first outer apron 20 which is protruded beyond by the all-round wall of the nozzle 2 towards the inflow side E, wherein this all-round wall of the nozzle 2 merges into a second outer apron 21. A groove 22 is formed between the first outer apron 20 and the second outer apron 21. The second outer apron 21 is preferably of shorter configuration than the first outer apron 22. An upper region 23 of the inner wall of the nozzle 2 has the same inclination towards the inner side of the inner apron 13 of the first carrier part 1. They form the orifice region which enables the same flow direction for the bypass flow B as for the main flow H.

At least the inner shell 12 and the inner apron 13 of the first carrier part 1 and at least one of the outer aprons 20, 21 of the nozzle 2 are of all-round configuration. They are preferably of identical configuration over their entire periphery. This also preferably applies to the outer shell 11 of the first carrier part 1 and to the other one of the two aprons 20, 21 of the nozzle 2.

Figure 5:
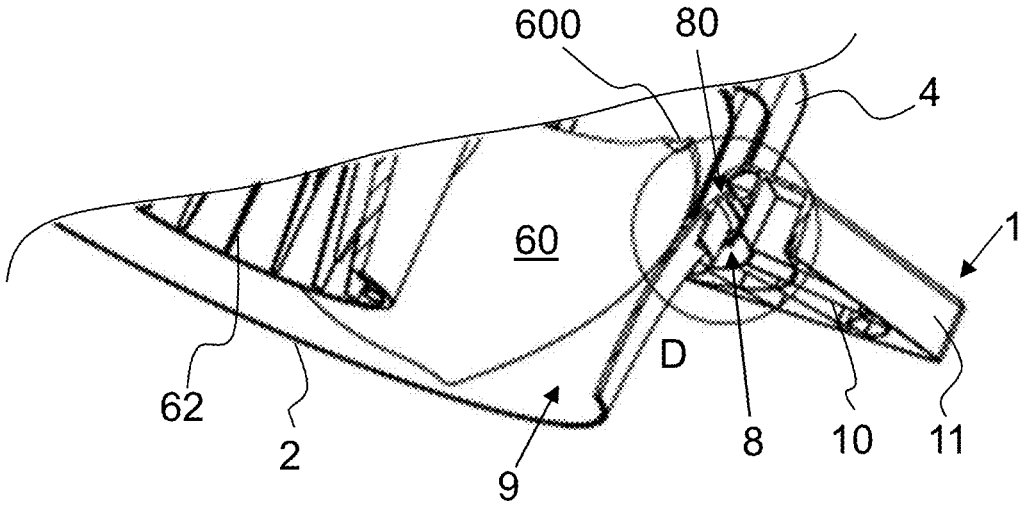
FIG. 5 shows a perspective illustration through a part of the axial fan according to FIG. 1.
Figure 6:
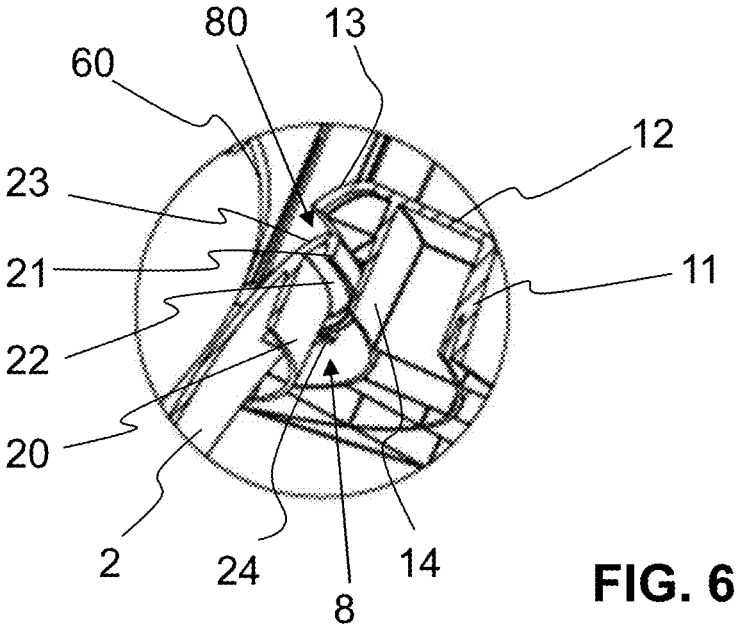
FIG. 6 shows an enlarged detail of the region D according to FIG. 5.

FIG. 6 is an enlarged detail of FIG. 5. The first carrier part 1 and the nozzle 2 can be seen more clearly in FIG. 5. It can be seen in FIGS. 5 and 7 that the bypass duct 8 has an orifice 80 into the main flow duct 9. The orifice 80 is situated downstream of the blade tips 600 in the main flow direction, that is to say in the axial direction of the impeller. It can be seen in FIG. 7, furthermore, that the orifice 80 or the orifice region of the bypass duct 8 is of slot-shaped configuration.

Figure 7:
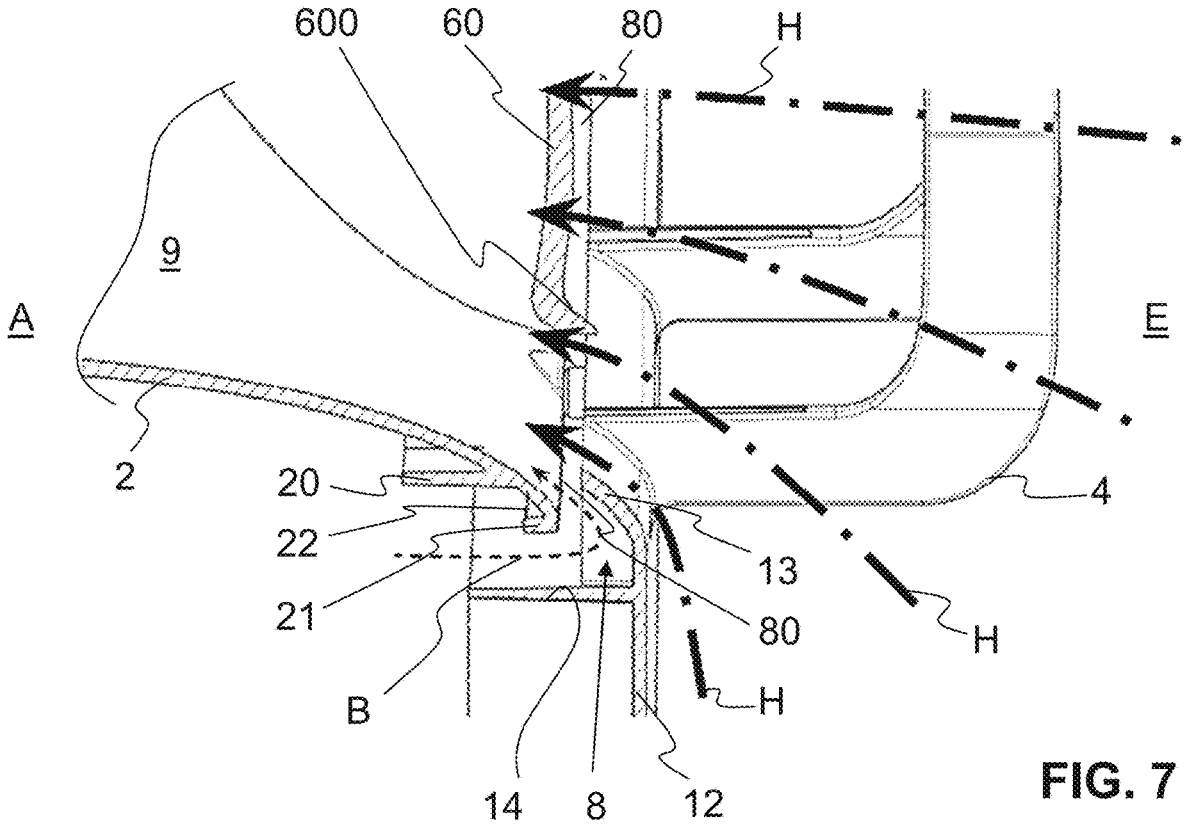
FIG. 7 shows a further perspective illustration through a part of the axial fan according to FIG. 1.

FIG. 7 shows the flow pattern of the air which flows through the fan.

Air which is sucked in by means of the rotation of the impeller 6 flows from the inflow side E in the form of a main flow H through the main flow duct 9 to the outflow side A. The main flow H is shown in FIG. 7 using a plurality of thick dash-dotted arrows. As can be seen in FIG. 7, it is deflected during the inflow into the nozzle 2, which is further amplified on account of the tapering of the nozzle 2. In other embodiments, there is no tapering present and/or the main flow is not deflected.

A part of the air flow which exits from the nozzle 2 on the outflow side A is returned, on account of the prevailing pressure conditions, along the outer side of the nozzle 2 and through the bypass 8 into the inflow region of the nozzle 2 again. Other air can also flow out of the positive pressure region of the nozzle 2 into the bypass duct 8 and into the main flow duct 9. The bypass flow B is shown in FIG. 7 using a fine dashed arrow. As can be seen by comparing the arrows of the two flows H, B, the flow directions of the main flow H and the bypass flow B are identical in the region of the orifice of the bypass duct 8 into the main flow duct 9. This is achieved, in particular, by the design of the orifice region. These flow directions are preferably identical to the direction of the all-round inner wall of the nozzle 2. As can be seen in FIG. 7, this inner wall is preferably curved and tapers in the direction of the outflow side A.

The bypass duct 8 preferably tapers towards the orifice 80. The orifice 80 preferably forms a smaller passage opening than the inlet of the bypass duct 8. The second outer apron 21 of the nozzle 2 reduces the cross section in comparison with the inlet of the bypass duct 8 which is formed by the first outer apron 20 and the inner shell 14 of the first carrier part 1. This can be seen in FIGS. 6 and 7. The bypass duct 8 preferably forms an arc, preferably of more than 90°, between the second outer apron 13 and the orifice 80.

The bypass duct 8 can also have a different shape. It can be of different configuration as a result of a different design of the first carrier part 1 and/or the nozzle 2 and/or with use of at least one further component. The bypass duct 8 is preferably arranged in the radial direction of the impeller 6 at a spacing from the blade tips on a greater radius. In the axial direction of the impeller 6, the bypass duct 8 is preferably situated at the same height as the blade tips. In other embodiments, it is upstream of the blade leading edge. In other embodiments, it is situated between the blade leading edge and the blade trailing edge of the impeller 6. The leading edge and the trailing edge are defined by the rotational direction of the impeller. The impeller wheel can be of different configuration. In particular, the blades and/or the blade tips can have different shapes. The bypass duct also provides an improvement in the aero-acoustics and the aerodynamics in the case of freely ending blades if there are no pronounced tips or no distinct or specifically shaped blade ends present.

The axial fan according to the invention reduces the noise emission and makes an extension of the stable operating range possible.

LIST OF REFERENCE SIGNS

1 Outer carrier part
10 Rib
11 Outer shell
12 Cover surface
13 Inner apron
14 Inner shell
2 Nozzle
20 First outer apron
21 Second outer apron
22 Groove
23 Upper region of the inner wall
24 Screw
3 Inner carrier part
4 Strut
5 Motor
6 Impeller
60 Blade
600 Blade tip
61 Ring
62 Rib
7 Air throughflow opening
8 Bypass duct
80 Orifice
9 Main flow duct
A Outflow side
B Bypass flow
E Inflow side
H Main flow
L Axis
S Main flow direction

The invention claimed is:

1. An axial fan with a nozzle and with a rotatable impeller which has freely ending blades forming blade tips, wherein the nozzle forms a main flow duct which connects an inflow side of the fan to an outflow side of the fan and defines a main flow direction as a result, wherein the nozzle surrounds the impeller, wherein the nozzle does not corotate with the impeller, wherein there is a bypass duct present which forms a flow connection from an outflow-side surrounding area of the nozzle into an inflow-side region of the main flow duct for the purpose of returning outflow-side air into the main flow duct of the nozzle, wherein the bypass duct opens in the main flow direction in a region of free ends of the blades of the impeller into the main flow duct, wherein the bypass duct opens in the main flow direction adjacently downstream of the blade tips of the impeller into the main flow duct, and wherein, when opening into the main flow duct, the bypass duct forms a step-free extension of an inner wall, following in the main flow direction, of the nozzle.

2. The axial fan according to claim 1, wherein the bypass duct has the same inflow direction as the main flow duct when opening into the main flow duct.

3. The axial fan according to claim 1, wherein the axial fan has a motor for driving the impeller, wherein the motor is connected upstream of the nozzle in the main flow direction.

4. The axial fan according to claim 1, wherein the axial fan has a carrier part, on which the impeller is arranged rotatably and on which the nozzle is arranged in a stationary manner, and wherein the bypass duct is formed between a wall of the carrier part and a wall of the nozzle.

5. The axial fan according to claim 4, wherein the wall of the carrier part and the wall of the nozzle have the same orientation and inclination when opening into the bypass duct.

6. The axial fan according to claim 5, wherein the axial fan has a motor for driving the impeller, wherein the motor is connected upstream of the nozzle in the main flow direction and wherein the carrier part is a motor carrier with an outer carrier part and an inner carrier part, wherein the nozzle is fastened to the outer carrier part, and wherein the motor is fastened to the inner carrier part.

7. The axial fan according to claim 6, wherein there are struts present which fasten the inner carrier part to the outer carrier part.

8. The axial fan according to claim 1, wherein the bypass duct is of all-round formation.

9. The axial fan according to claim 1, wherein the bypass duct is formed to be multiple times smaller in terms of a flow length and a cross section of the bypass duct than the main flow duct.

10. The axial fan according to claim 1, wherein the bypass duct has an inlet opening which has a greater cross section than an outlet opening of the bypass duct.

11. The axial fan according to claim 1, wherein the bypass duct forms an arc before opening into the main flow duct.

12. The axial fan according to claim 1, wherein the nozzle tapers at least in its inlet-side region towards the outflow side.

13. The axial fan according to claim 12, wherein the nozzle tapers over an entire length of the nozzle towards the outflow side.

14. An axial fan with a nozzle and with a rotatable impeller which has freely ending blades forming blade tips, wherein the nozzle forms a main flow duct which connects an inflow side of the fan to an outflow side of the fan and defines a main flow direction as a result, wherein the nozzle surrounds the impeller, wherein the nozzle does not corotate with the impeller, wherein there is a bypass duct present which forms a flow connection from an outflow-side surrounding area of the nozzle into an inflow-side region of the main flow duct for the purpose of returning outflow-side air into the main flow duct of the nozzle, wherein the bypass duct opens in the main flow direction in the region of the free ends of the blades of the impeller into the main flow duct, wherein the bypass duct opens in the main flow direction adjacently downstream of the blade tips of the impeller into the main flow duct, wherein the axial fan has a carrier part, on which the impeller is arranged rotatably and on which the nozzle is arranged in a stationary manner, and wherein the bypass duct is formed between a wall of the carrier part and a wall of the nozzle, and wherein the wall of the carrier part and the wall of the nozzle have the same orientation and inclination when opening into the bypass duct.

15. The axial fan according to claim 14, wherein the axial fan has a motor for driving the impeller, wherein the motor is connected upstream of the nozzle in the main flow direction and wherein the carrier part is a motor carrier with an outer carrier part and an inner carrier part, wherein the nozzle is fastened to the outer carrier part, and wherein the motor is fastened to the inner carrier part.

16. The axial fan according to claim 15, wherein there are struts present which fasten the inner carrier part to the outer carrier part.

17. The axial fan according to claim 14, wherein the bypass duct is of all-round formation.

18. The axial fan according to claim 14, wherein the bypass duct has the same inflow direction as the main flow duct when opening into the main flow duct.

* * * * *